US009197022B2

(12) United States Patent
Yang

(10) Patent No.: US 9,197,022 B2
(45) **Date of Patent: *Nov. 24, 2015**

(54) ELECTRICAL CONNECTOR

(71) Applicant: Cheng Uei Precision Industry Co., Ltd., New Taipei (TW)

(72) Inventor: Chih-Lin Yang, New Taipei (TW)

(73) Assignee: CHENG UEI PRECISION INDUSTRY CO., LTD., New Taipei (TW)

( * ) Notice: Subject to any disclaimer, the term of this patent is extended or adjusted under 35 U.S.C. 154(b) by 23 days.

This patent is subject to a terminal disclaimer.

(21) Appl. No.: 14/179,544

(22) Filed: Feb. 12, 2014

(65) Prior Publication Data

US 2015/0229081 A1 Aug. 13, 2015

(51) Int. Cl.

| | |
|---|---|
| ***H01R 13/15*** | (2006.01) |
| ***H01R 13/432*** | (2006.01) |
| ***H01R 24/60*** | (2011.01) |
| ***H01R 13/506*** | (2006.01) |
| *H01R 107/00* | (2006.01) |

(52) U.S. Cl.
CPC ..... *H01R 24/60* (2013.01); *H01R 13/506* (2013.01); *H01R 2107/00* (2013.01)

(58) Field of Classification Search
CPC ..... H01R 13/193; H01R 24/60
USPC ..... 439/260, 263, 676
See application file for complete search history.

(56) References Cited

U.S. PATENT DOCUMENTS

| | | | | |
|---|---|---|---|---|
| 6,435,892 | B1 * | 8/2002 | Billman | 439/260 |
| 8,662,916 | B2 * | 3/2014 | Ashibu | 439/495 |
| 8,956,171 | B2 * | 2/2015 | Wang | 439/260 |
| 2010/0151716 | A1 * | 6/2010 | Suzuki et al. | 439/260 |
| 2010/0184317 | A1 * | 7/2010 | Sunaga | 439/260 |

* cited by examiner

*Primary Examiner* — Briggitte R Hammond
(74) *Attorney, Agent, or Firm* — Cheng-Ju Chiang

(57) ABSTRACT

An electrical connector includes an insulating housing defining an inserting chamber and terminal grooves communicating with the inserting chamber, electrical terminals of which each has an elastic arm received in the terminal groove and a contact portion protruding towards the inserting chamber at a front end of the elastic arm, and a pressing member slidably sleeved round a front of the insulating housing. A plurality of pressing boards are protruded at inner sides of the pressing member and projects in the terminal grooves to resist against the elastic arms. The contact portions are located in the terminal grooves when the pressing member is at an initial position. After a mating connector is mated with the electrical connector, push the pressing member rearward to make the pressing blocks press the elastic arms so as to make the contact portions project into the inserting chamber and contact with the mating connector.

9 Claims, 5 Drawing Sheets

ELECTRICAL CONNECTOR

BACKGROUND OF THE INVENTION

1. Field of the Invention

The present invention generally relates to a connector, and more particularly to an electrical connector.

2. The Related Art

Along with the development of modern information technology, people use multimedia devices with increasing frequency, so people demand for flash drives and other electronic products increases, at the same time the quality of the docking products are increasingly high requirements. Manufacturers in order to guarantee the production of the docking qualified product quality, so it is necessary to test compliance of the production of the docking connector.

However, in test, the existing test connector in the process of detecting docking connector, when inserted into the test connector for testing, electrical terminals of the docking connector and electrical terminals of the detection connector interfere with each other in contact, electrical terminals of the product and the electrical connector interfere with each other so that often easily scrapes the product under test.

SUMMARY OF THE INVENTION

An object of the present invention is to provide an electrical connector adapted for mating with a mating connector. The electrical connector includes an insulating housing, a plurality of electrical terminals and a pressing member. The insulating housing has a top wall, a bottom wall, a rear wall and two side walls which together surround an inserting chamber thereamong. The top wall and the bottom wall define a plurality of terminal grooves vertically penetrating therethrough to communicate with the inserting chamber and each extending along a front-to-rear direction. The plurality of electrical terminals are disposed in the terminal grooves of the insulating housing, Each electrical terminals has an elastic arm elastically received in the terminal groove, and a contact portion protruding towards the inserting chamber at a front end of the elastic arm. The contact portion is located in the front of the terminal groove. The pressing member has a top board, a bottom board, a front board and two side boards. The pressing member is slidably sleeved round a front part of the insulating housing. Two inner sides of the top board and the bottom board protrude face-to-face inward to form two rows of pressing boards which are arranged at regular intervals in accordance with the terminal grooves of the insulating housing to project in the terminal grooves and the pressing boards can be put into the sliding grooves and sliding backwards to push the electrical terminals into the inserting chamber.

When the pressing member is at an initial position relative to the insulating housing, the contact portions of the electrical terminals are located in the terminal grooves and there is no interference between the electrical terminals and the mating connector in the process of inserting the mating connector into the electrical connector; after the mating connector is completely mated with the electrical connector, push the pressing member to slide rearward along the insulating housing, the pressing boards slide along the corresponding elastic arms of the electrical terminals and press the elastic arms to make the contact portions project into the inserting chamber so as to realize electrical connection with the mating connector.

As described above, there is no interference between the electrical terminals and the mating connector in the process of inserting the mating connector into the electrical connector, and an electrical connection is realized between the electrical terminals and the mating connector by virtue of pushing the pressing member to slide rearward along the insulating housing after the mating connector is completely mated with the electrical connector, so that effectively avoid scraping the mating connector in the process of insertion and extraction.

BRIEF DESCRIPTION OF THE DRAWINGS

The present invention will be apparent to those skilled in the art by reading the following description, with reference to the attached drawings, in which.

DETAILED DESCRIPTION OF THE PREFERRED EMBODIMENT

Figure 1:
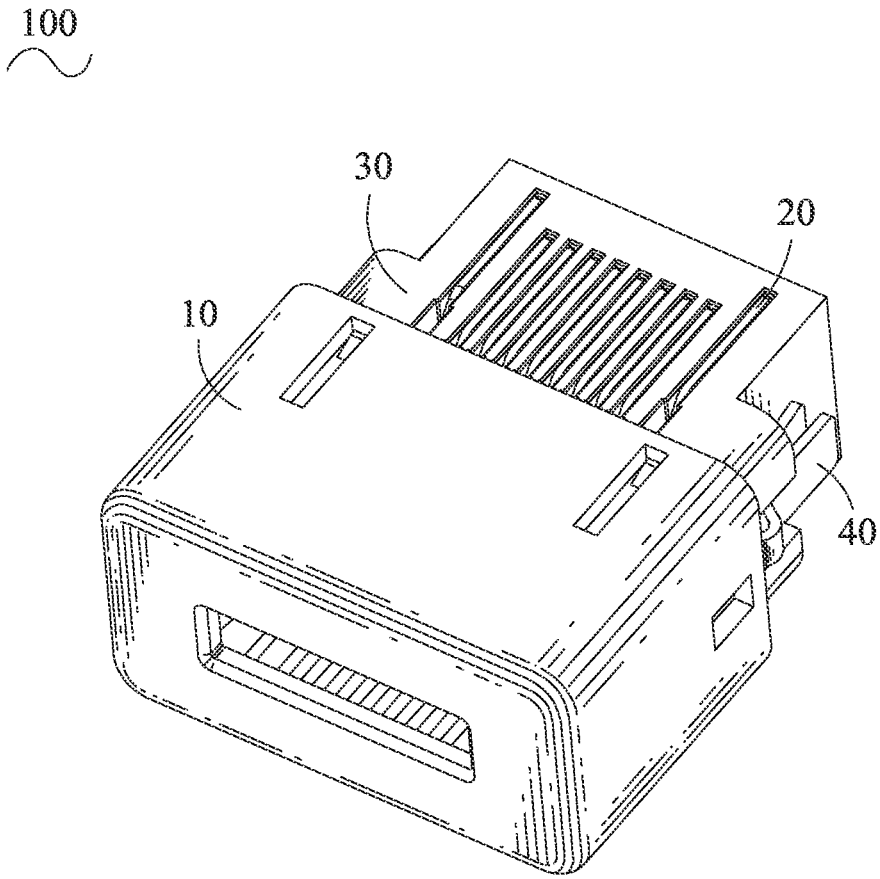
FIG. 1 is an assembled perspective view of an electrical connector according to an embodiment of the present invention.

With reference to FIG. 1, an electrical connector 100 in accordance with an embodiment of the present invention is adapted for mating with a mating connector (not shown). The electrical connector 100 includes an insulating housing 10, a plurality of electrical terminals 20, a pressing member 30 and a pair of latches 40.

Figure 2:
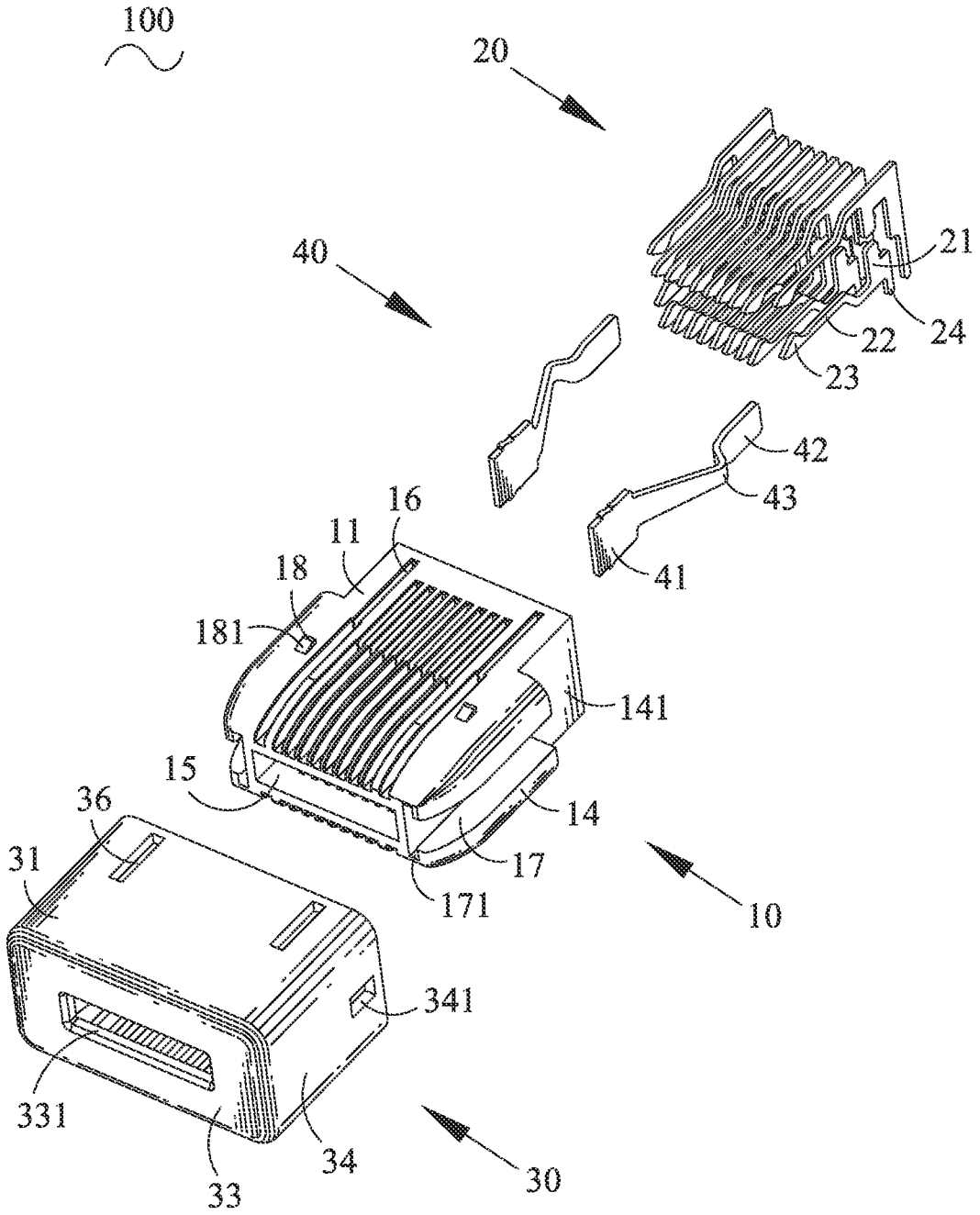
FIG. 2 is an exploded perspective view of the electrical connector of FIG. 1.
Figure 3:
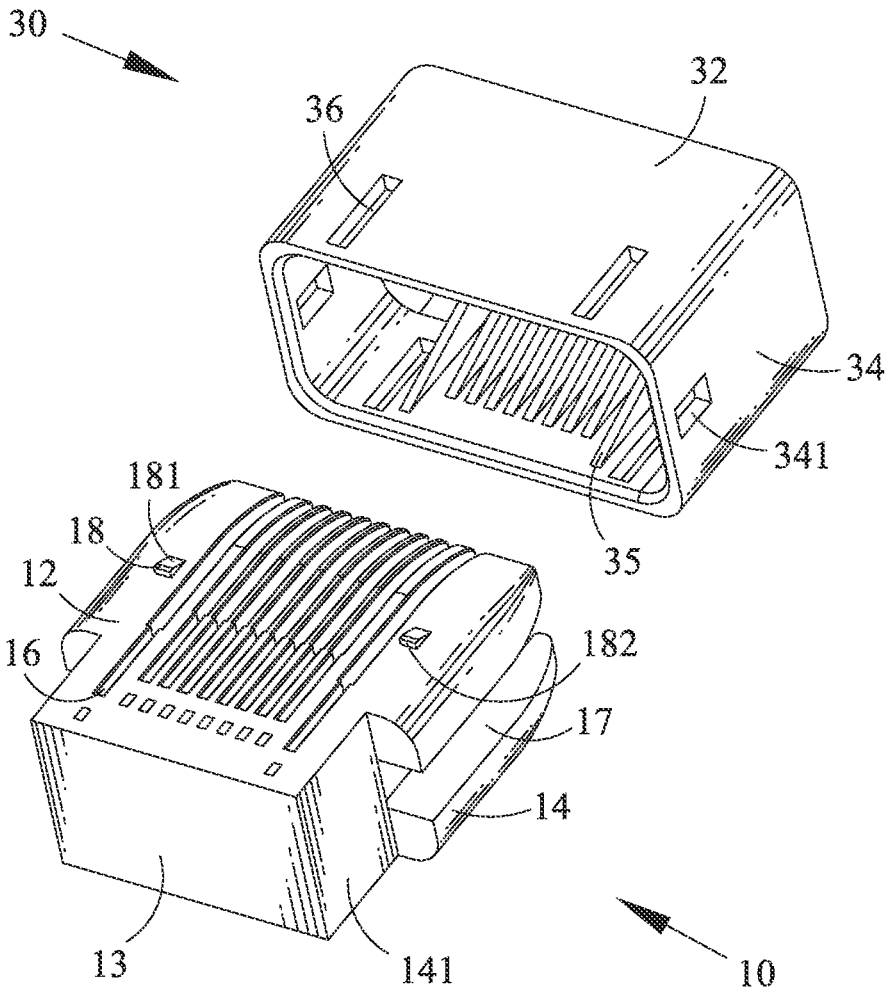
FIG. 3 is an exploded perspective view of the electrical connector which removes the electrical terminals and latches of FIG. 1.
Figure 4:
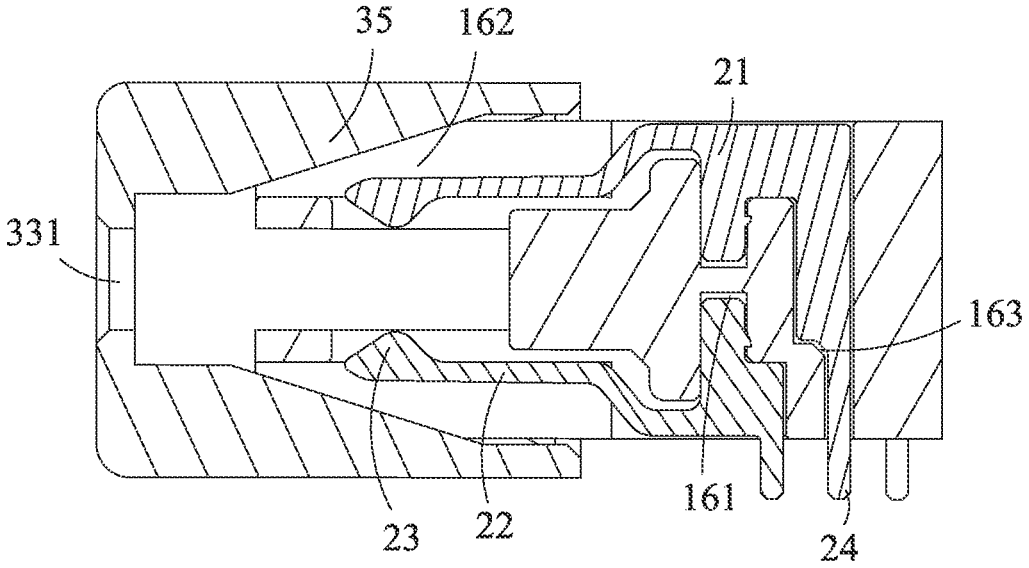
FIGS. 4-5 are cross-sectional views showing that a pressing member of the electrical connector of FIG. 1 is at two different positions relative to the insulating housing of the electrical connector of FIG. 1.

Referring to FIG. 2, FIG. 3 and FIG. 4, the insulating housing 10 has a top wall 11, a bottom wall 12, a rear wall 13 and two side walls 14 which together surround an inserting chamber 15 thereamong. The top wall 11 and the bottom wall 12 define a plurality of terminal grooves 16 which are opened symmetrically about the inserting chamber 15 and vertically penetrate through the top wall 11 and the bottom wall 12 respectively to communicate with the inserting chamber 15 and each extending along a front-to-rear direction. Each terminal grooves 16 includes a retaining groove 161, a sliding groove 162 and a welding groove 163. The retaining grooves 161 are opened in the rear wall 13 which vertically penetrate through the top wall 11 and the bottom wall 12. The sliding grooves 162 are opened in the top wall 11 and the bottom wall 12 which vertically penetrate through the top wall 11 and the bottom wall 12. The welding grooves 163 are opened in the rear wall 13 which vertically penetrate through the bottom wall 12. The retaining grooves 161, sliding grooves 162 and welding grooves 163 are connected before and after. Two opposite outsides of the side walls 14 are concaved inward to form a pair of mounting channels 17 extending along the front-to-rear direction to penetrate through the corresponding side walls 14. The inner wall of the mounting channels 17 are concaved up and down to form a pair of fixed grooves 171 respectively. Two rear ends of the two opposite outsides of the side walls 14 are concaved inward to form a pair of gaps 141 vertically extending to penetrate through the corresponding side walls 14. A plurality of blocking blocks 18 protruded in front of the left and right ends of the top wall 11 and the bottom wall 12. In every front of the blocking blocks 18 is an inclined surface 181 from the front to rear, the back end of the blocking blocks 18 is a vertical resist surface 182.

Referring to FIG. 1 and FIG. 2, the electrical terminals 20 are symmetrically arranged in two rows and disposed in the terminal grooves 16 of the insulating housing 10. Each electrical terminals 20 has a board-shaped fastening portion 21, an elastic arm 22 extending forward and then extending inward from a front edge of the fastening portion 21 and inclined towards the inserting chamber 15 in the process of extending forward, a contact portion 23 protruding towards the inserting chamber 15 from a distal end of the elastic arm 22, and a soldering portion 24 extending rearward then extending down from a rear edge of the fastening portion 21. The fastening portion 21 vertically fastened in the corresponding retaining groove 161. The elastic arm 22 is received in the sliding grooves 162 with the contact portion 23 is also located in the front of the terminal groove 16 when the electrical connector 100 is not in use. The soldering portion 24 is received in the welding groove 163 and the rear of the soldering portion 24 stretches rearward out of the terminal groove 16 and projects under the bottom wall 12.

Referring to FIG. 2, FIG. 3 and FIG. 4, the pressing member 30 is a rectangular frame which has a top board 31, a bottom board 32, front board 33 and two side boards 34. In the middle of the front board 33 is opened a plug slot 331. Two sides of each top board 31 and the bottom board 32 are opened with a pair of sliding slots 36 each extending along a front-to-rear direction. Two inner sides of the top board 31 and the bottom board 32 protrude face-to-face are equipped with a plurality of pressing boards 35. Each row of the pressing boards 35 are arranged at regular intervals between one pair of the sliding slots 36 and in accordance with the terminal grooves 16 of the insulating housing 10 opened in the top/bottom wall 11/12, so the pressing boards 35 can be put into the sliding grooves 162 and sliding backwards to push the electrical terminals 20 into the inserting chamber 15. Two opposite outsides of the side boards 34 back-end are opened a pair of fixing holes 341.

Referring to FIG. 2, each latches 40 has a fixed part 41, an elastic part 42 extending outward and then extending inward from a back edge of the fixed part 41, a raised part 43 protruding towards the middle of the elastic part 42. The fixed parts 41 of the latches 40 fixed within the fixed grooves 171, the front of the elastic parts 42 installed in the mounting channels 17, and the rear of the elastic parts 42 above the gaps 141.

The pressing member 30 is slidably sleeved round a front part of the insulating housing 10. The pressing boards 35 project in the terminal grooves 16 respectively. The blocking blocks 18 are located in the corresponding sliding slots 36 and the resist surfaces 182 against rear sidewalls of the sliding slots 46 and apart from front sidewalls of the sliding slots 36. Referring to FIG. 4, in this state, insert the mating connector into the inserting chamber 15 of the electrical connector 100. At this time, the contact portions 23 of the electrical terminals 20 are still in the terminal grooves 16, namely there is no electrical connection between the electrical terminals 20 and the mating connector. In this state, the resist surfaces 182 of the blocking blocks 18 are assembled against the rear sidewalls of the sliding slots 36 so as to avoid the pressing member 30 falling off the front part of the insulating housing 10.

Figure 5:
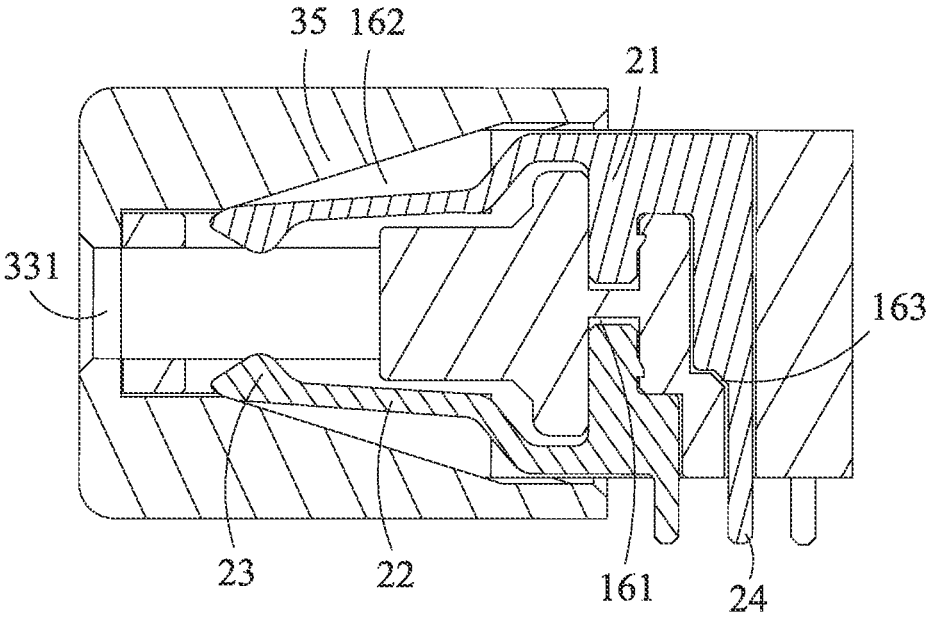

Referring to FIG. 4 and FIG. 5, when the pressing member 30 is at an initial position relative to the insulating housing 10, the contact portions 23 of the electrical terminals 20 are located in the terminal grooves 16 and there is no interference between the electrical terminals 20 and the mating connector in the process of inserting the mating connector into the electrical connector 100; after the mating connector is completely inserted in the electrical connector 100, push the pressing member 30 to slide rearward along the insulating housing 10. At this moment, the contact portions 23 of the electrical terminals 20 are pressed by the pressing boards 35 to electrically contact with the mating connector. In detail, in the process of the pressing member 30 sliding rearward, the pressing boards 35 slide along the corresponding elastic arms 22 of the electrical terminals 20 and press the elastic arms 22 to make the contact portions 23 project into the inserting chamber 15 so as to realize electrical connection with the mating connector, and simultaneously, at this time, push the rear of the elastic parts 42, and then the raised parts 43 of the latches 40 are located in the corresponding fixing holes 341 of the pressing member 30 so as to avoid the pressing member 30 sliding forward.

As described above, the terminal grooves 16 in the top wall 11 and the terminal grooves 16 in the bottom wall 12 are symmetrical about the inserting chamber 15, and the electrical terminals 20 are symmetrically arranged in two rows and disposed in the terminal grooves 16 of the insulating housing 10, so the mating connector can be mated with the electrical connector 100 in positive and negative directions. Furthermore, because of the two inner sides of the top board 31 and the bottom board 32 protrude face-to-face are equipped with a plurality of pressing boards 35. Each row of the pressing boards 35 are arranged at the terminal grooves 16 of the insulating housing 10 opened in the top/bottom wall 11/12, so the pressing boards 35 can be put into the sliding grooves 162 and sliding backwards to push the electrical terminals 20 into the inserting chamber 15. There is no interference between the electrical terminals 20 and the mating connector in the process of inserting the mating connector into the electrical connector 100, and the electrical connection is realized between the electrical terminals 20 and the mating connector by virtue of pushing the pressing member 30 to slide rearward along the insulating housing 10 after the mating connector is completely mated with the electrical connector 100, so that effectively avoid scraping the mating connector in the process of insertion and extraction.

What is claimed is:

1. An electrical connector adapted for mating with a mating connector, comprising:

an insulating housing has a top wall, a bottom wall, a rear wall and two side walls which together surround an inserting chamber thereamong, the top wall and the bottom wall define a plurality of terminal grooves vertically penetrating therethrough to communicate with the inserting chamber and each extending along a front-to-rear direction;

a plurality of electrical terminals are disposed in the terminal grooves of the insulating housing, each electrical terminals has an elastic arm elastically received in the terminal groove, and a contact portion protruding towards the inserting chamber at a front end of the elastic arm, the contact portion is located in the front of the terminal groove; and a pressing member has a top board, a bottom board, a front board and two side boards, the pressing member is slidably sleeved round a front part of the insulating housing, two inner sides of the top board and the bottom board protrude face-to-face inward to form two rows of pressing boards which are arranged at regular intervals in accordance with the terminal grooves of the insulating housing to project in the terminal grooves and the pressing boards can be put into the sliding grooves and sliding backwards to push the electrical terminals into the inserting chamber;

wherein when the pressing member is at an initial position relative to the insulating housing, the contact portions of the electrical terminals are located in the terminal grooves and there is no interference between the electrical terminals and the mating connector in the process of inserting the mating connector into the electrical connector; after the mating connector is completely mated with the electrical connector, push the pressing member to slide rearward along the insulating housing, the pressing boards slide along the corresponding elastic arms of the electrical terminals and press the elastic arms to make the contact portions project into the inserting chamber so as to realize electrical connection with the mating connector.

2. The electrical connector as claimed in claim 1, wherein each terminal grooves further includes a retaining groove, a sliding groove and a welding groove which are connected before and after, the retaining grooves are opened in the rear wall which vertically penetrate through the top wall and the bottom wall, the sliding grooves are opened in the top wall and the bottom wall which vertically penetrate through the top wall and the bottom wall, the welding grooves are opened in the rear wall which vertically penetrate through the bottom wall; each of the electrical terminals has a board-shaped fastening portion, an elastic arm extending forward and then extending inward from a front edge of the fastening portion and inclined towards the inserting chamber in the process of extending forward, a contact portion protruding towards the inserting chamber from a distal end of the elastic arm, and a soldering portion extending rearward then extending down from a rear edge of the fastening portion.

3. The electrical connector as claimed in claim 2, wherein the fastening portion vertically fastened in the corresponding retaining groove, the elastic arm is received in the sliding grooves with the contact portion is also located in the front of the terminal groove when the electrical connector is not in use, the soldering portion is received in the welding groove and the rear of the soldering portion stretches rearward out of the terminal groove and projects under the bottom wall.

4. The electrical connector as claimed in claim 1, wherein a plurality of blocking blocks protruded in front of the left and right ends of the top wall and the bottom wall of the pressing member, in the middle of the front board is opened a plug slot; for the insulating housing, two sides of each of the top board and the bottom board are opened with a pair of sliding slots each extending along a front-to-rear direction.

5. The electrical connector as claimed in claim 4, wherein in every front of the blocking blocks is an inclined surface from the front to rear, the back end of the blocking blocks is a vertical resist surface, when the pressing member is at an initial position relative to the insulating housing, the blocking blocks are located in the corresponding sliding slots and the resist surfaces against rear sidewalls of the sliding slots and apart from front sidewalls of the sliding slots.

6. The electrical connector as claimed in claim 1, wherein two opposite outsides of the side boards back-end of the pressing member are opened a pair of fixing holes; two opposite outsides of the side walls of the insulating housing are concaved inward to form a pair of mounting channels extending along the front-to-rear direction to penetrate through the corresponding side walls, the inner wall of the mounting channels are concaved up and down to form a pair of fixed grooves respectively, two rear ends of the two opposite outsides of the side walls are concaved inward to form a pair of gaps; the electrical connector also include a pair of latches, each of the latches has a fixed part, an elastic part extending outward and then extending inward from a back edge of the fixed part, a raised part protruding towards the middle of the elastic part.

7. The electrical connector as claimed in claim 5, wherein the fixed parts of the latches fixed within the fixed grooves, the front of the elastic parts installed in the mounting channels, and the rear of the elastic parts above the gaps, when push the pressing member to slide rearward along the insulating housing, push the rear of the elastic parts, and then the raised parts of the latches are located in the corresponding fixing holes of the pressing member.

8. The electrical connector as claimed in claim 1, wherein the terminal grooves are opened symmetrically about the inserting chamber and the electrical terminals are symmetrically arranged in two rows.

9. The electrical connector as claimed in claim 1, wherein the bottom of the pressing boards tilted forward and upward.

* * * * *